US006919776B1

(12) United States Patent
Möbius et al.

(10) Patent No.: US 6,919,776 B1
(45) Date of Patent: Jul. 19, 2005

(54) TRAVELING WAVE DEVICE FOR COMBINING OR SPLITTING SYMMETRIC AND ASYMMETRIC WAVES

(75) Inventors: Arnold Möbius, Eggenstein (DE); Robert Lawrence Ives, Saratoga, CA (US)

(73) Assignee: Calabazas Creek Research, Inc., Saratoga, CA (US)

( * ) Notice: Subject to any disclaimer, the term of this patent is extended or adjusted under 35 U.S.C. 154(b) by 171 days.

(21) Appl. No.: 10/128,187

(22) Filed: Apr. 23, 2002

(51) Int. Cl.[7] ..... H01P 5/12
(52) U.S. Cl. ..... 333/125; 333/137
(58) Field of Search ..... 333/123–127, 333/129–137; 330/286

(56) References Cited

U.S. PATENT DOCUMENTS

| | | | | | |
|---|---|---|---|---|---|
| 3,873,935 | A | | 3/1975 | Oltman | 330/287 |
| 3,931,587 | A | | 1/1976 | Harp et al. | 331/56 |
| 4,074,265 | A | * | 2/1978 | True | 342/15 |
| 4,175,257 | A | | 11/1979 | Smith et al. | 330/287 |
| 4,188,590 | A | | 2/1980 | Harp et al. | 331/56 |
| 4,453,139 | A | | 6/1984 | Labaar | 331/47 |
| 4,588,962 | A | | 5/1986 | Saito | 330/286 |
| 4,590,446 | A | * | 5/1986 | Hsu et al. | 333/125 |
| 4,677,393 | A | | 6/1987 | Sharma | 330/286 |
| H664 | H | * | 8/1989 | Kinman et al. | 331/56 |
| 5,142,253 | A | * | 8/1992 | Mallavarpu et al. | 333/127 |
| 5,446,426 | A | | 8/1995 | Wu et al. | 333/125 |
| 5,880,648 | A | * | 3/1999 | Aves et al. | 333/127 |
| 6,242,984 | B1 | * | 6/2001 | Stones et al. | 330/295 |

* cited by examiner

*Primary Examiner*—Minh Nguyen
(74) *Attorney, Agent, or Firm*—Jay A. Chesavage

(57) ABSTRACT

A traveling wave device for the combining or splitting of symmetric and asymmetric traveling wave energy includes a feed waveguide for traveling wave energy, the feed waveguide having an input port and a launching port, a reflector for coupling wave energy between the feed waveguide and a final waveguide for the collection and transport of wave energy to or from the reflector. The power combiner has a launching port for symmetrical waves which includes a cylindrical section coaxial to the feed waveguide, and a launching port for asymmetric waves which includes a sawtooth rotated about a central axis.

42 Claims, 12 Drawing Sheets

Input Waveguide

Section views

Geometric Optics, collapsed section view reflector geometry, single feed guide, single reflector, final guide Geometric Optics, collapsed section view
4 feed guides, 4 reflectors, and final guide Wave propagation in a waveguide using geometrical optics (projection view)

Prior Art

Wave propagation in a waveguide with g.o. ray summing

Prior Art

Reflector Detail

Geometric Optics, collapsed section view

Power summing in final waveguide

TRAVELING WAVE DEVICE FOR COMBINING OR SPLITTING SYMMETRIC AND ASYMMETRIC WAVES

This invention was made with Government support under grant DE-FG03-97ER82343 awarded by the Department of Energy. The government has certain rights in this invention.

FIELD OF THE INVENTION

The current invention is directed to the class of power combiners comprising a plurality of input waveguides, hereafter referred to as feed waveguides summing input power into a single output waveguide, hereafter called a final waveguide. Because of symmetrical behavior in the present invention between input and output ports, the relevant field of the present invention also includes power splitters having a single input port dividing the power applied to this port into a plurality of output ports, dividing the power according to a desired ratio between these ports.

The present invention includes the class of power combiners which sum wave energy from a plurality of waveguides, each carrying traveling TE, TM, and HEmn mode electromagnetic waves. The traveling electromagnetic waves may be propagating either in a symmetric mode or in an asymmetric mode. The present power combiner has several feed waveguides, a reflector for each feed waveguide, and a single final waveguide.

BACKGROUND OF THE INVENTION

In applications requiring the summing of a large number of output from klystrons launching TE01 mode waves into cylindrical waveguides, it has been necessary to first convert the waves to TE00 functional waves, and summing according to prior art techniques.

Examples of prior art power combiners are the class of circular power combiners such as U.S. Pat. No. 5,446,426 by Wu et al, which describes a device accepting microwave power from the resonant cavity of a microwave oscillator, and summing into a circularly symmetric waveguide for delivery to an output port. U.S. Pat. No. 4,175,257 by Smith et al describes another circular power combiner comprising radial input ports which furnish microwave power which is summed along a principal axis. U.S. Pat. No. 4,684,874 by Oltman describes another radially symmetric power combiner/divider, and U.S. Pat. No. 3,873,935 describes an elliptical combiner, whereby input energy is provided to one focus of the ellipse, and removed at the other focus. In all of these combiners, the output port is orthogonal to the input port, and the wave mode is TM, rather than TE.

U.S. Pat. No. 4,677,393 by Sharma describes a power combiner/splitter for TE waves comprising an input port, a parabolic reflector, and a plurality of output ports.

For complete understanding of the present invention, a review of well-known traveling wave principles relevant to the prior art should be explained. References for traveling wave phenomenon are "Fields and Waves in Communication Electronics" by Ramo, Whinnery, and Van Duzer, Chapter 7 "Gyrotron output launchers and output tapers" by Mobius and Thumm in "Gyrotron Oscillators" by C. J. Edgcombe, and "Open Waveguides and Resonators" by L. A. Weinstein.

Circular waveguides support a variety of traveling wave types. Modes are formed by waves which propagate in a given phase with respect to each other. For a given free-space wavelength λ, a circular waveguide is said to be overmoded if the diameter of the waveguide is large compared to the wavelength of a wave traveling in it. An overmoded waveguide will support many simultaneous wave modes traveling concurrently. If the wave propagates axially down the waveguide, the wave is said to be a symmetric mode wave. If the wave travels helically down the waveguide, as shown in FIG. 16, the wave is said to be an asymmetric mode wave. In the case where two identical asymmetrical helical waves are combined, the result is an asymmetric wave mode propagating axially. In the case of the present invention, helically propagating waves will be considered.

Transverse electric, transverse magnetic, or hybrid modes propagating in cylindrical waveguides have two integer indices. The first index is the azimuthal index m which corresponds to the number of variations in the azimuthal direction, and the second index is the radial index n that corresponds to the number of radial variations of the distribution of either the electric or magnetic field component. While the radial index n always has to be larger than zero, the azimuthal index m can be equal to zero. Due to their azimuthal symmetry, modes with m=0 are called symmetric modes whereas all other modes are called asymmetric. Asymmetric modes can be composed of a co- and counter-rotating mode with has the consequence that—as in the case of symmetric modes—the net power flow (real part of the poyntingvector) only occurs in the axial direction. However, if either to co- or counter-rotating mode is present there is a net energy flow in axial and azimuthal direction, hence we obtain a helical propagation. For the present invention helically propagating or symmetric modes are considered.

When using a ray-optical approach to the modes, a decomposition of the modes as plane waves with the limit of zero wavelength rays are obtained. In general, these are tangent to a caustic with a radius:

$$Rc=Rw(m/Xmn)$$

where:

Rc is the radius of the caustic

Rw is the radius of the waveguide

Xm is the eigenvalue of the mode

This has the consequence that the geometrical rays have an azimuthal, radial, and axial coordinate. However, in the case of symmetric modes, the radius of the caustic becomes zero, and hence the rays representing symmetric modes only have a radial and an axial component. In the design of a reflector, the phase front of the rays tangent to a caustic is required. In an asymmetric mode, this phase front is the involute of the caustic. For a symmetric mode, the phase front reduces to a point representing the caustic with a radius=0.

In a cylindrical waveguides, the radial component of the ray does not contribute to the net flow. This however changes as soon as the waveguides has a port which causes a net power flow in the radial direction.

The phase front for an asymmetric mode wave is described by an involute in free space, a shape which is inwardly curled towards the center of the waveguide. The particular shape for the phase front for each wave mode unique, and is generally numerically calculated. The important aspect of the phase front is that it defines a particular surface, and this phase front will be used later for construction of certain structures of the invention.

Traveling waves can also be described in terms of the propagation velocity in a particular direction. Symmetric waves traveling down the axis of the waveguide have a purely axial component, and no perpendicular component. Asymmetric waves traveling helically down the axis of a waveguide have both an axial component, and a perpendicular component. There is a wave number $k=2\pi/\lambda$, where $\lambda$ is the wavelength of the traveling wave. In each axial (parallel) direction and transverse (perpendicular) direction of travel, the following wave numbers may be computed:

$$k_{perp}=X_{mn}/Rw$$

$$k_{par}=sqrt\{k^2=k_{perp}^2\}$$

In these calculations, $X_{mn}$ is the eigenvalue of the mode m is the azimuthal index Rw is the waveguide radius.

For asymmetric mode waves, the internally reflecting waves define a circle within the waveguide radius Rw known as a caustic. The radius of the caustic for an asymmetric mode wave is $$Rc=Rw(m/X_{mn})$$

Where

Rc=radius of caustic

Rw=radius of waveguide m=azimuthal index n=radial index $X_{mn}$ is the eigenvalue of the mode In cylindrical waveguides, the distance Lc represents the length of waveguide for which propagating TEmn, TMmn, or HEmn waves propagating in a cylindrical wavelength complete a 2n phase change. The formula for Lc is $$Lc=2\pi Rw\{k_{par}sqrt\{1=(m/X_{mn})^2\}\}/\{k_{perp}cos^{-1}(m/X_{mn})\}$$

where

Rw, m, n, $X_{mn}$, $k_{perp}$, $k_{par}$ are as previously defined

OBJECTS OF THE INVENTION

A first object of the invention is the summation of a plurality of symmetric waves such as TE01, TE02, TE03, etc. from a plurality of feed waveguides into a single final waveguide.

A second object of the invention is the summation of a plurality of asymmetric waves with azimuthal index m>0 such as TE11, TE12, TE21, etc. from a plurality of feed waveguides into a single final waveguide.

A third object of the invention is the summation of a plurality of either traveling symmetric or traveling assymetric waves, each traveling wave coupled into a feed waveguide, thereafter coupled to a feed waveguide launching port, thereafter to a reflector, and thereafter to a summing final waveguide.

A fourth object of the invention is the splitting of a plurality of either traveling symmetric or traveling asymmetric waves applied to a final waveguide, these traveling waves thereafter coupled to a reflector, and thereafter coupled to a plurality of feed waveguides,

SUMMARY OF THE INVENTION

A power combiner has a plurality of feed waveguides, each feed waveguide having an input port and a launching port. The input port accepts either symmetric or asymmetric traveling waves, and the launching port emits these traveling waves to a focusing reflector. Each launching port has its own focusing reflector. A plurality of feed waveguides and focusing reflectors is arranged about a central axis. A final waveguide is disposed on this central axis for the transport of combined wave energy reflecting of the reflectors. Each feed waveguide is energized with a source of traveling wave energy, and this traveling wave energy is directed to the reflectors by the launching port of the feed waveguide, combining in the final waveguide.

DETAILED DESCRIPTION OF THE INVENTION

Figure 1:
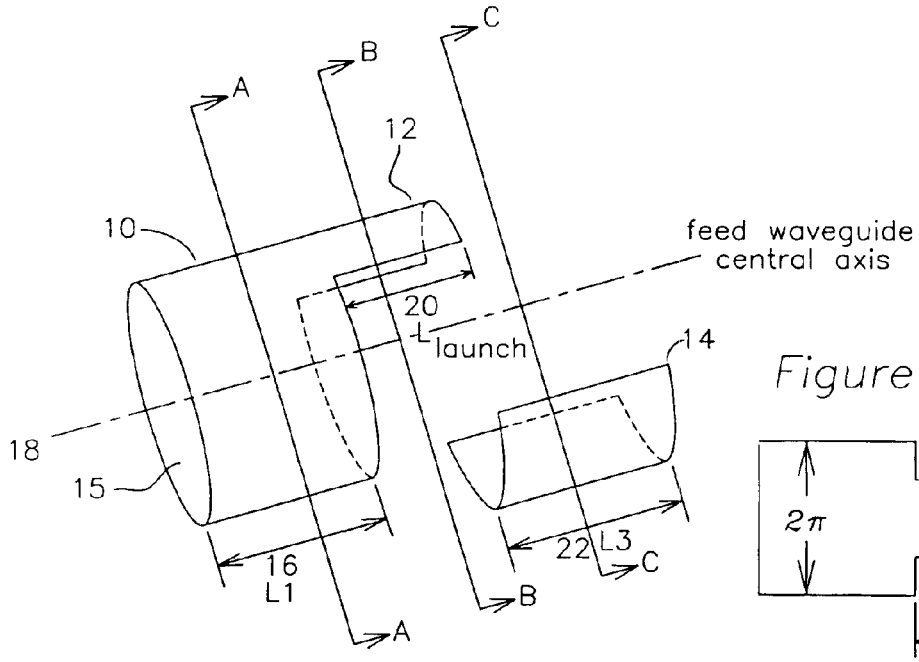
FIG. 1 shows a single feed waveguide and a reflector for symmetric mode waves.
Figure 2:
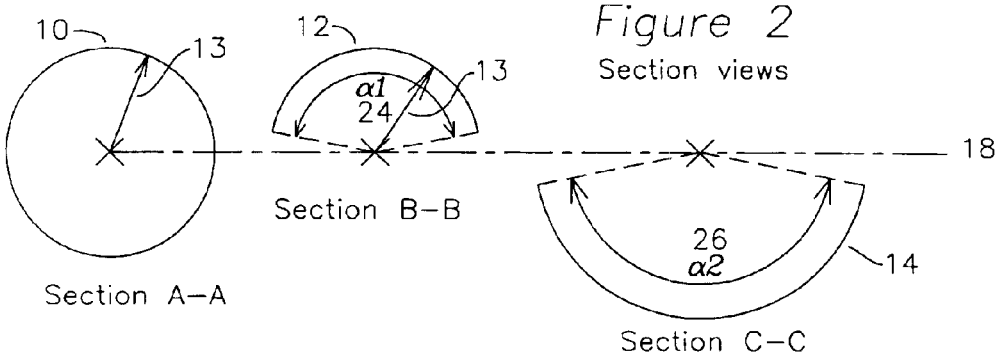
FIG. 2 shows a cross sectional views of FIG. 1

FIG. 1 shows a feed waveguide 10 arranged about a feed waveguide axis 18, and FIG. 2 shows the cross sections of the related structures of FIG. 1. Typically, these feed waveguides are fed by high power klystrons in $TE_{01}$ mode from a cylindrical waveguide. The feed guide 10 has a radius 13, an input port 15, and a launching port 12 centered on the feed waveguide axis 18. In one embodiment optimized for symmetric waves, the feed waveguide 10 has a cylindrical part L1 16 which is of a sufficient length to remove higher mode waves that may be present in the feed waveguide, a feed port 15 for receiving input power, and a launch port 12 for directing wave energy towards a reflector 14. The first section of the feed waveguide is shown in section A—A of FIG. 2. FIG. 1 shows a launch port section 12 which comprises a cylindrical section having the same diameter and waveguide axis 18 as the input section, and further has a length $L_{launch}$ of the launch port which is optimally $$L_{launch}=Lc/2$$

where $L_{launch}$ is the length of the feature 20 in FIG. 1

$Lc=2\pi Rf\{k_{par}\text{sqrt}\{1-(m/X_{mn})^2\}\}/\{k_{perp}\cos^{-1}(m/X_{mn})\}$. As described earlier, Lc represents the length of a waveguide section for which propagating TEmn, TMmn, or HEmn waves propagating in a cylindrical wavelength complete a $2\pi$ phase change.

Rf is the radius of the feed waveguide $k_{par}$ is the parallel, or axial wave number m is the azimuthal index of the mode $X_{mn}$ is the eigenvalue of the mode $K_{perp}$ is the perpendicular wave number For a symmeteric move wave, m=0, and so the equation for Lc simplifies to $$Lc=4Rf\{k_{par}\}/\{k_{perp}\}$$

and therefore $$L_{launch}=2Rf\{k_{par}\}/\{k_{perp}\}$$

Figure 1A:
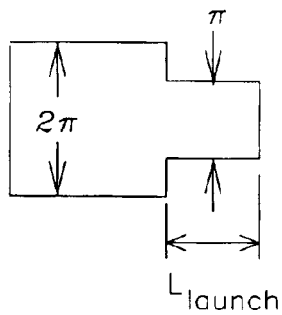
FIG. 1*a* shows the detail of a feed waveguide when unfolded into a plane.

FIG. 1*a* shows the feed waveguide 10 unfolded onto a planar surface with the features dimensioned for clarity.

FIG. 2 shows the cross section B—B of the second section having an included angle $\alpha 1$ 24 which is preferably 180 degrees. The angular extent of the reflector 14 may be greater or smaller than 180 degrees, depending on the location of the center of the reflector with respect to the feed waveguide axis 18, and the spatial requirements of the other reflectors. In general, the available included angle for each reflector will be 360/k degrees, where k is the number of feedguides present, as will be explained later with FIG. 8. In FIG. 2, focusing reflector 14 may comprise an elliptical surface having an included angle $\alpha 2$ 26 determined by the included angle 64*a* and 64*a*' of FIG. 8, which will be 360/k degrees, where k is the number of feed waveguides present. The length L3 22, should be of sufficient length to enable reflection of most of the incident power from a launching port 12 into a final waveguide. The launching port 12 may be defined as the cylindrical section formed by sweeping a line of length $L_{launch}$, with a separation from the feed waveguide axis 18 equal to feed waveguide radius 13 about an included angle $\alpha 1$ 24. Focusing reflector 14 is disposed about feed waveguide axis 18, and has a length L3 sufficient to reflect waves leaving the feed waveguide 10 into the final waveguide.

Figure 3:
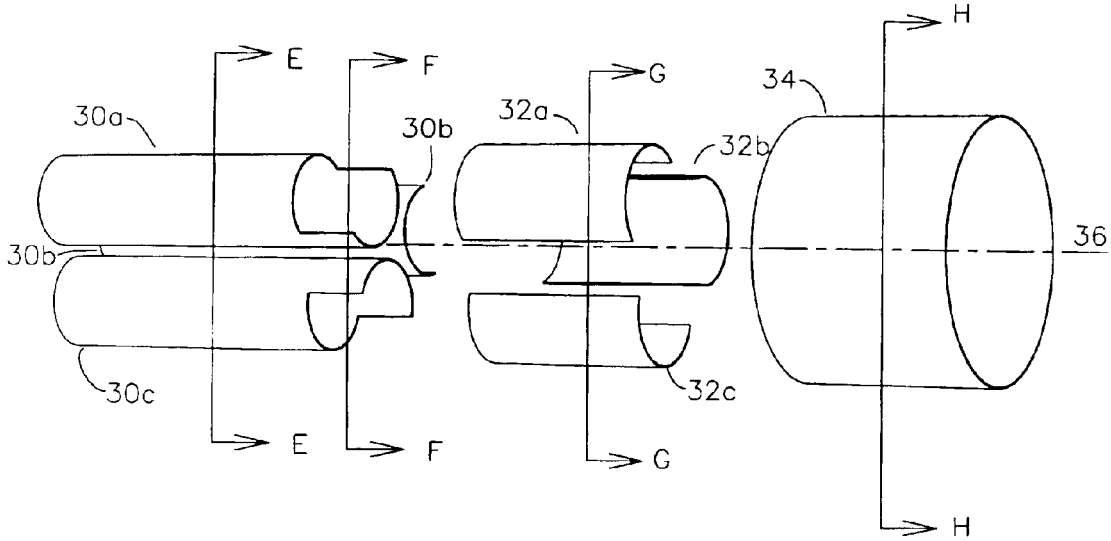
FIG. 3 shows a power combiner which sums input power from three symmetric wave sources.
Figure 4:
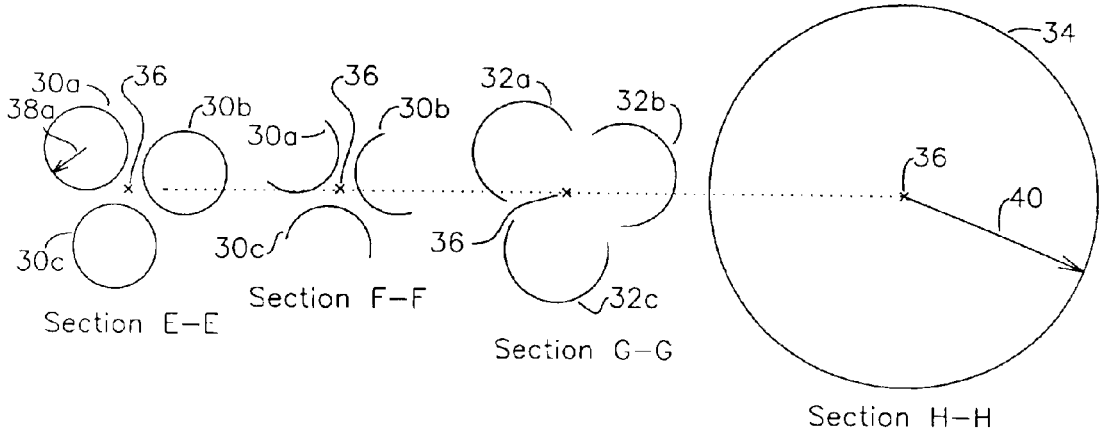
FIG. 4 shows the cross sectional views of FIG. 3

FIG. 3 shows a power combiner comprising three feed waveguides 30*a,* 30*b,* and 30*c*. Incoming sources of symmetric wave energy enter each of the three feed waveguides 30*a,* 30*b,* and 30*c,* which are arranged symmetrically about a power combiner central axis 36, also shown in section E—E of FIG. 4. The symmetric wave energy exists at the feed waveguide launching port, shown in section F—F of FIG. 4. Focusing reflectors 32*a,* 32*b,* and 32*c* act on energy exiting each of feed waveguides 30*a,* 30*b,* and 30*c* respectively. Each feed waveguides is arranged with its feed waveguide central axis parallel to the power combiner central axis 36. The focusing reflectors direct wave energy to final waveguide 34. FIG. 4 shows the section details of the structures of FIG. 3. Section E—E shows the feed waveguides 30*a,* 30*b,* and 30*c* of FIG. 3. Each of the feed waveguides 30*a,* 30*b,* and 30*c* has an identical radius 38, shown only on waveguide 30*a* as 38*a* for clarity. Section F—F shows the launching ports of feed waveguides 30*a,* 30*b,* and 30*c*. Section G—G shows the arrangement of focusing reflectors 32*a,* 32*b,* and 32*c,* which will be described in detail later. Section H—H shows the cylindrical sectional view of final waveguide 34, which has a radius 40, and is disposed about the central axis 36. In accordance with best mode shown in FIG. 4 section F—F, the launching ports are convex with respect to the power container central axis 36, while the reflectors 32*a,* 32*b,* 32*c* of section G-13 G are concave with respect to the power combiner central axis 36. In an alternate construction, each of the feed waveguides could be rotated 180 degrees about its own respective waveguide axis to produce launch ports which are concave when viewed in section F—F of FIG. 4, and each of the reflectors could be rotated 180 degrees about each feed waveguide central axis to produce reflectors which are convex with respect to the power combiner central axis 36. As is clear to one skilled in the art, this arrangement would produce a feed waveguide launching port which directs energy towards the central axis 36, and would be reflected by each reflector to the final waveguide 34. However, it is believed that the arrangement of FIG. 3 would produce the best power combiner. Also, while the feed waveguide radius 38 is shown as equal for each of the feed waveguides, it is possible for the power combiner to have unequal feed waveguide radii for each feed waveguide. While the feed waveguides of FIG. 3 are shown distributed equally about the central axis 36 as is believed to be the best mode, it is also possible to arrange the feed waveguides with an unequal angular distribution. This angular distribution could be described in terms of the included angle formed between the planes which include each feed waveguide axis and the power combiner axis 36.

In the final waveguide 34, different wave modes may be present than were present in the feed waveguide 30, so that wave mode in the final waveguide will be described in TEpq, where p & q are the final waveguide mode numbers. For the final waveguide, the radius Rfinal and wave mode indices p and q should be chosen such that the brillouin angle for the mode in the final waveguide matches the brillouin angle for the mode in the feed waveguide. Since the radius Rfinal is generally larger than the radius of the individual feed waveguides, the mode indices will be higher as well. If the two feed waveguides carry $TE_{01}$ mode, and it is desired to carry $TE_{02}$ in the final guide, then $R_{final}$ may be determined by $$R_{final}=R_{feed}(X_{02}/X_{01}).$$

In general, $$R_{final}=R_{feed}(X_{mn}/X_{pq})$$

where $R_{final}$=radius of final waveguide $R_{feed}$=radius of feed waveguide $X_{mn}$=eigenvalue of mode in feed waveguide $X_{pq}$=eigenvalue of mode in final waveguide In addition to the above selection or Rfinal, the additional constraint Lfeedhelix=Lfinaldepth must be met. Since this criterion will generally not be met for a given feed waveguide mode and final waveguide mode, this is accomplished by utilizing the observation that the spectrum of eigenvalue of the various modes is dense. This constraint is met by making an appropriate selection between the available wave modes found in the feed waveguide and final waveguide, and the feed and final waveguide radii.

Figure 5:
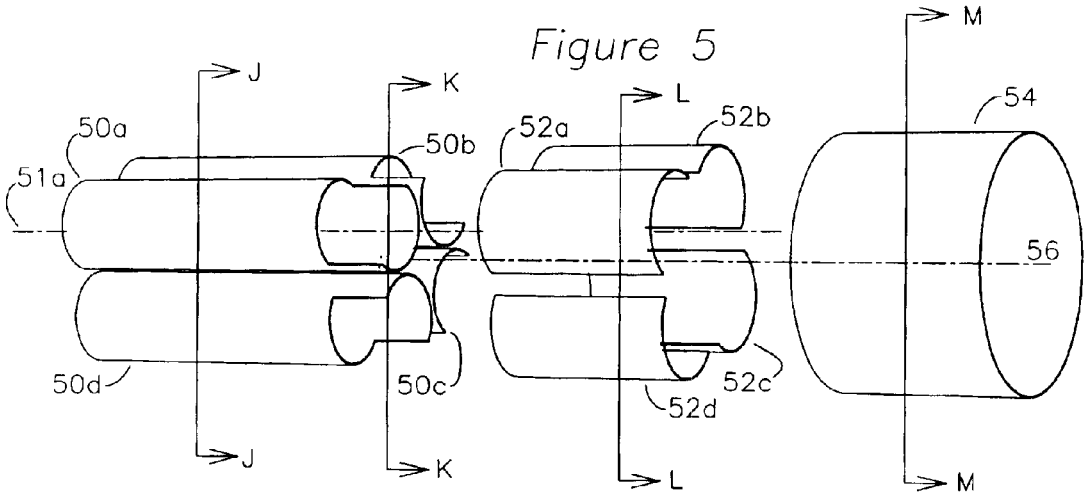
FIG. 5 shows a power combiner which combines input power from four symmetric wave sources.
Figure 6:
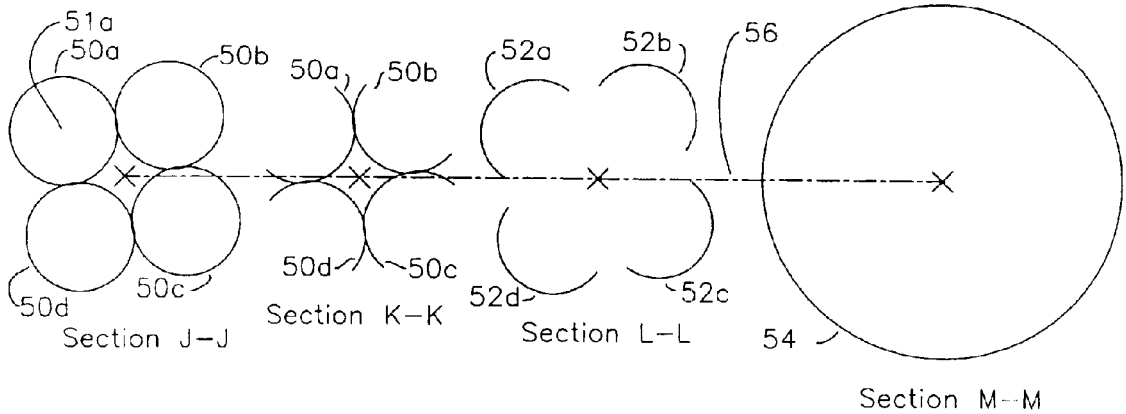
FIG. 6 shows the cross sectional views of FIG. 5.

FIG. 5 shows a power combiner with 4 feed waveguides 50*a,* 50*b,* 50*c,* and 50*c.* Symmetric mode wave energy enters each of the feed waveguides 50, and is directed to a launching port, as before. The wave energy leaving each launching port 50*a,* 50*b,* 50*c,* and 50*d* is sent to each reflector 52*a,* 52*b,* 52*c,* and 53*d,* and thereafter is reflected to final waveguide 54. FIG. 6 shows the cross sectional views of the power combiner/splitter of FIG. 5. Section J—J shows the arrangement of feed guides 50*a*–50*d,* including the launching ports of section K—K. Section L—L shows the reflectors 52*a*–52*d,* and section M—M shows the output guide 54.

Figure 7:
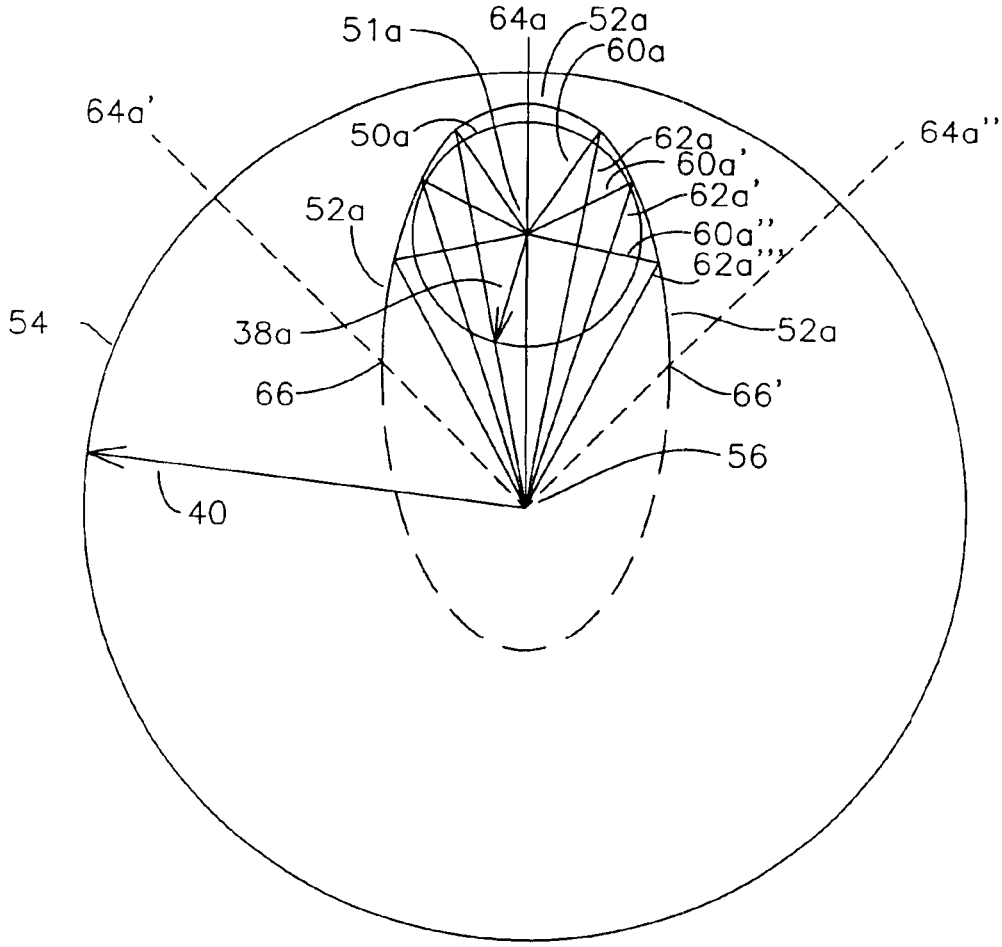
FIG. 7 shows the details of the reflector construction in a collapsed section view.

FIG. 7 shows the construction details for a single reflector, shown as reflector 52*a* of FIG. 5. The reference points of FIG. 7 are the final waveguide axis 56 and the feed waveguide axis 51*a.* Wave energy leaves the center of feed guide 51*a* and is directed to the center of final waveguide 54. These two points are used to construct the locus of points which define the reflector 52. By the geometric optics technique of ray tracing, the reflector 52 is formed by the locus of points forming an equidistant total path from a first focus 51*a,* to the reflector 52*a,* and to the center of the final waveguide 54. In FIG. 7, each exit path 60*a,* 60*a',* 60*a"* is reflected from reflector 52*a,* and is directed to second focus 56 via reflected path 62*a,* 62*a',* and 62*a",* respectively. The total path length 60*a*+62*a*=60*a'*+62*a'*=60*a"*+62*a",* etc. Feed guide radius 38*a* and final guide radius 40 are also shown. The extent of reflector 52*a* is typically determined by the included angle about reflector reference plane 64*a,* formed by sweeping a plane which includes the main axis 56 about waveguide axis 51*a.* The solid angular extent of the reflector 50*a* is shown as the included angle from reflector extent 64*a*' to reflector extent 64*a",* which is typically symmetric about the reflector axis 64*a.* The angle from 64*a*' to 64*a*" is determined by the number of reflectors present. In the case p=3 of 3 reflectors and 3 feed waveguides, the included angle of the reflector is 360/3=120 degrees. For the case p=4 of 4 reflectors and 4 feed waveguides, the included angle is 360/4=90 degrees. Any number of feedguides and reflectors may be accommodated in this manner. The reflector 52*a* comprises the locus of points providing equal path length from first focus to second focus, and is truncated by the included angle formed by 64*a'.* to 64*a",* which enables the reflectors for the other feed guides to utilize the remaining space.

Once the locus of points, which defines the reflector 52*a* is determined as described above, it may be used to form the shape of the reflector along the waveguide axis 56. The formation of the reflector solid 52 from the locus of reflector points may be thought of as an extrusion of the locus of points along the power combiner axis 56 to form the reflectors 52*a*,52*b*,52*c*,52*d* of FIG. 5, or any of the other reflectors shown in previous figures. The axial extent of the reflector may be chosen based on minimum power loss when coupling energy from the launching ports to the final waveguide. This axial extent is approximately the value Lc defined earlier.

Figure 8:
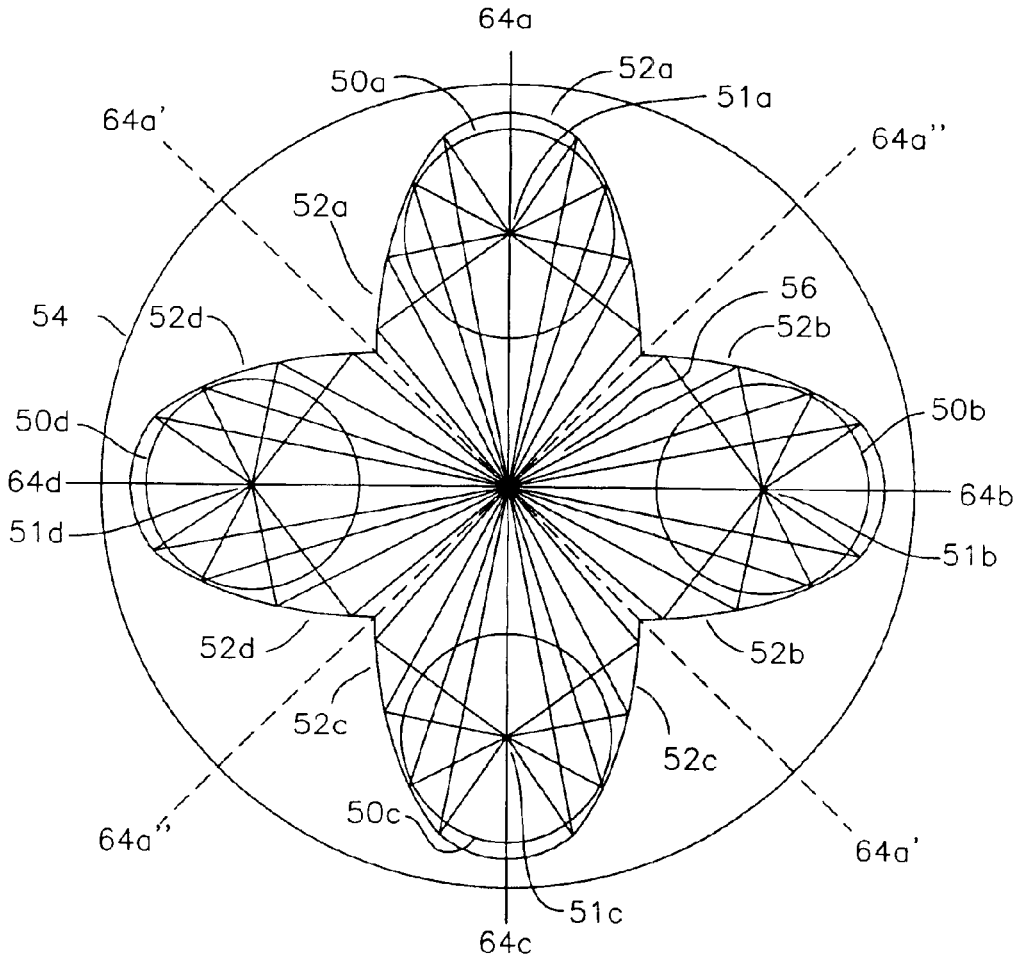
FIG. 8 shows a collapsed section view of the reflector, feed waveguides, and final waveguides for the power combiner of FIG. 5.

FIG. 8 shows the arrangement of feed guides, reflectors, output guides for the case where k=4. Each feed guide 50*a,* 50*b,* 50*c,* 50*d* has a central axis, and reflectors 52*a,* 52*b,* 52*c,* and 52*d* respectively dispose wave energy to the central axis of final waveguide 54. Each reflector is symmetrically located about the connecting line between the two focal points, one at the central axis 56 and the other located at each feed guide center 51*a,* 51*b,* 51*c,* and 51*d.* These are also shown by the lines 64*a,* 64*b* 64*c,* and 64*d.* Typically, each feed waveguide and each reflector waveguide is coaxially arranged, although other arrangements, such as an angular offset between feed waveguides and reflectors could be accommodated. The result of the arrangement of feed waveguides, reflectors, and final waveguides in FIG. 8 is that input power from each feed waveguide 50*a*–*d* is reflected by reflector 52*a*–*d,* and is focused at the center of final waveguide 54.

Figure 9:
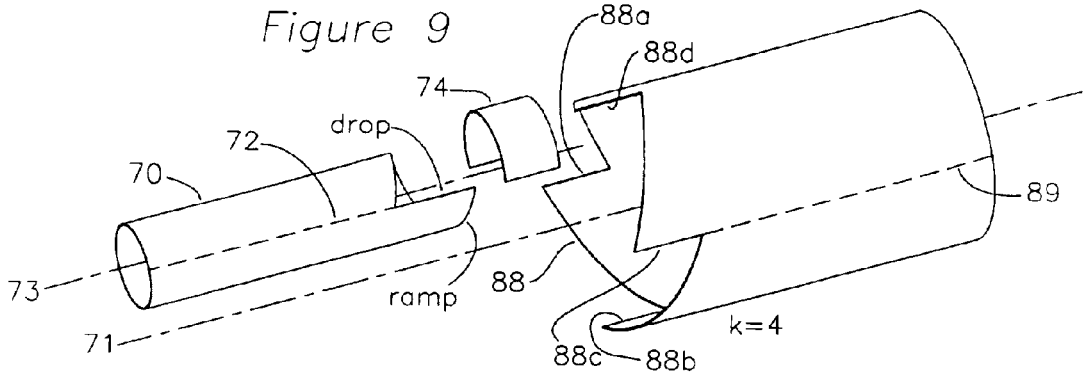
FIG. 9 shows a single feed waveguide, a reflector, and a final waveguide for asymmetric waves.
Figure 10:
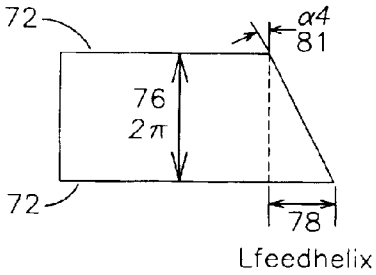
FIG. 10 shows a feed waveguide for asymmetric wave sources, the feed waveguide shown unwound onto a planar surface for clarity.

FIG. 9 shows the power summer/splitter for asymmetric mode waves. In the general case, a plurality of feed waveguides 70 would be used, but only one is shown in this figure for clarity. Asymmetric mode waves travel in a helical path, as will be described later. Feed waveguide 70 includes a feed waveguide axis 73, and a reference line 72 is shown to assist in understanding the actual shape of the feed guide. If feed guide 70 were unfolded about reference line 72, the shape would be as shown in FIG. 10. The circumference of feed guide 70 is equal to the number of wavelengths of the azimuthal mode, which is m wavelengths, or 2*pi*m radians in phase, and includes an exit surface of length 78 for the launching of waves towards the reflector 74 of FIG. 9. Feed guide central axis 73 is shown offset from main axis 71. Final waveguide 88 may be constructed on one of two different ways. For the special case where $(\phi_c)/2\pi=(1/n)\text{arc cos}\,(m/X_{mn})$ is an integer, where m=azimuthal index n=radial index $X_{mn}$=the eigenvalue of the mode the final waveguide may be a simple cylinder without the multicuts 88*a,* 88*b,* 88*c,* etc. For all other cases, the final waveguide includes a multi-cut input wave surfaces 88*a,* 88*b,* 88*c,* and 88*d,* as shown in FIG. 9.

The feed waveguide 70 of FIG. 9 includes a helical launch port which may be described by sweeping a line of length $L_{feedlaunch}=\theta*L_{feedhelix}/2n$ at the radius of the launch port from and parallel to said feed guide axis, where $0\leqq\theta\leqq2\pi$ and θ is the angle in radians about the feed waveguide axis 73 and $L_{feedhelix}$ is the depth of the helical cut 78. $L_{feedhelix}$ may be computer by $$L_{feedhelix}=Lc$$

where $Lc=2\pi R_{feed}\{k_{par}\text{sqrt}\{1-(m/X_{mn})^2\}\}/\{k_{perp}\cos^{-1}(m/X_{mn})\}$ $k_{par}$ is the parallel, or axial wave number $R_{feed}$ is the radius of the feed waveguide m is the azimuthal index of the mode $X_{mn}$ is the eigenvalue of the mode $K_{perp}$ is the perpendicular wave number Sweeping the line $L_{feedlaunch}$ produces the helical launch ramp shown in FIGS. 9 and 10.

As shown in FIG. 9, the multicuts 88*a*, 88*b*, 88*c*, 88*d* of the reflector port of the final waveguide may be constructed by sweeping a line of varying length $L_{finalmulticut}$ at the final waveguide radius from said central guide axis about an angle θ:

$$L_{finalmulticut}=(Lc/k)*(\theta/(k*2*pi)) \text{ for } 0\leq\theta\leq 2*pi/k$$

where $Lc=9\pi R_{final}\{k_{par}sqrt\{1-(p/X_{pq})^2\}\}/\{k_{perp}\cos^{-1}(p/X_{pq})\}$ (Lc/k) is the multicut depth 77

$k_{par}$ is the parallel, or axial wave number $R_{final}$ is the radius of the final waveguide p is the azimuthal index of the mode q is the radial index of the mode $X_{pq}$ is the eigenvalue of the mode $K_{perp}$ is the perpendicular wave number k is the number of multicuts The multicut of the final waveguide is formed by joining end-for-end k said surfaces of rotation to form a cylindrical solid, as shown in FIG. 9 for the case k=4.

FIG. 9 also defines a drop and a ramp, which will be used later to show orientation of the helix in projection with respect to the helical cut. The drop may also be defined to be the location where θ=0 in the earlier definition of $L_{feedlaunch}$.

As was described earlier for the symmetric mode case, final waveguide 88 may have different wave modes present than were present in the feed waveguides 70, so the wave mode in the final waveguide will be described as TEpq, where p & q are the final waveguide mode numbers. For the final waveguide, the radius Rfinal and wave mode indices p and q should be chosen such that the brillouin angle for the mode in the final waveguide matches the brillouin angle for the mode in the feed waveguide. Since the radius Rfinal is generally larger than the radius of the individual feed waveguide, the mode indices will be higher as well. If the two feed waveguides carry $TE_{01}$ mode, and it is desired to carry $TE_{02}$ in the final guide, then $R_{final}$ may be determined by $$R_{final}=R_{feed}(X_{02}/X_{01}).$$

In general, $$R_{final}=R_{feed}(X_{mn}/X_{pq})$$

where $R_{final}$=radius of final waveguide $R_{feed}$=radius of feed waveguide $X_{mn}$=eigenvalue of mode in feed waveguide $X_{pq}$=eigenvalue of mode in final waveguide In addition to the above selection or Rfinal, the additional constraint Lfeedhelix=Lfinaldepth must be met. Sine this criterion will generally not be met for a given feed waveguide mode and final waveguide mode, this is accomplished by utilizing the observation that the spectrum of eigenvalues of the various modes is dense. By making an appropriate selection between the available wave modes found in the feed waveguide and final waveguide, and the feed and final waveguide radii, it is possible to meet this constraint.

Figure 11:
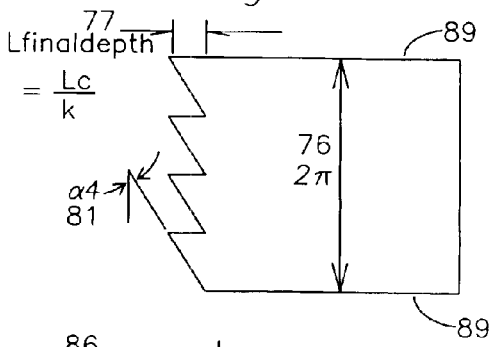
FIG. 11 shows a final waveguide for asymmetric wave summing, the final waveguide shown unwound onto a planar surface for clarity.

FIG. 11 shows the final waveguide 88 unfolded to a planar surface about reference line 89. In practice, helically propagating waves exit feed waveguide 70, are reflected by helical reflector 74, and are collected by multicut input final waveguide 88, entering at multicut surface 88*a* and other surfaces 88*b*, 88*c*, and 88*d*, as shown by the ray traces 80, 82 84, and 86. These rays enter at angle α4 81. The value of angle α4 81 is not the same as the brillouin angle but can be computed from $$\tan \alpha 4=\{k_{par}sqrt\{1-\{p^2/X_{pq}^2\}\}\}/\{k_{perp}\cos^{-1}\{p/X_{pq}\}\}$$

where p≠0, and the other variables are as earlier defined. The final waveguide has final multicuts 88*a*,88*b*,88*c*,88*d*, of depth $$L_{finaldepth}=L_c/k,$$

with parameters as defined earlier.

Figure 12:
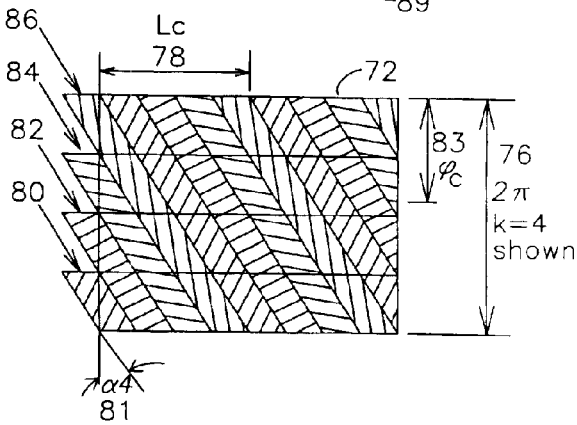
FIG. 12 shows final waveguide of FIG. 11 unwound onto a planar surface, and with shaded areas showing the progressions of traveling wave energy

FIG. 12 shows the path of input waves collected by each multicut collection surface, and includes an input surface for the multicut, each multicut surface corresponding to a surface collecting wave energy from each reflector, and directing it to each multi-cut surface, as will be described later. The angular hatch patterns represent approximations of wave energy as it travels through the structure. For example, examining the multicut port 84, the series of identical hatch patterns correspond to the wave energy propagating through this path, which continues at the connection point at the top 4 bands to the right. Lc is shown graphically as the width of k bands (shown as k=4), and the Lfinaldepth 77 is Lc/k, as shown in FIG. 11. $\phi_c$ 83 is shown for reference, and will be described in detail later in FIG. 15. The circumference of final waveguide 88 is shown in FIGS. 11 and 12 as $L_{launch}$.

Figure 13A:
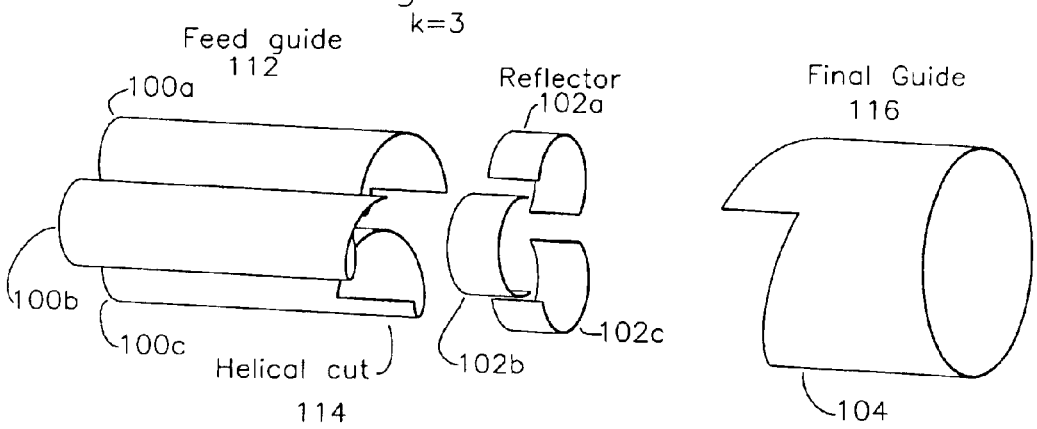
FIGS. 13*a* and 13*b* show different views of a power combiner for asymmetric mode input power which is summing asymmetric mode input power from 3 sources.
Figure 13B:
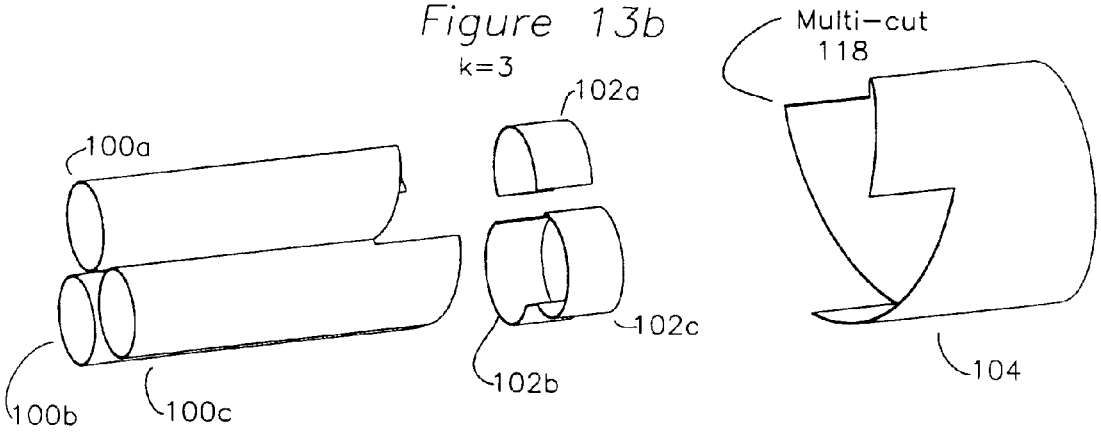

FIG. 13*a* shows for k=3 an asymmetric mode, 3 port power summing/dividing structure. Each feed guide 100*a*, 100*b*, and 100*c* has helically traveling waves which launch at the helical cut end 114 of each feed guide. The helical cut angle and feed guide diameter is designed as described in FIG. 10. The three reflectors 102*a*, 102*b*, and 102*c* capture and reflect wave energy leaving each feed guide 100*a*, 100*b*, and 100*c* respectively, and feed this energy into each multicut surface of the multicut final guide 116. Each multicut 118 is arranged to capture traveling wave energy from each reflector 102. FIG. 13*b* shows a different perspective view of FIG. 13*a* for clarity in viewing the multicut final waveguide, and it can be seen that wave energy leaving each reflector 102*a*, 102*b*, 102*c* is captured by each multicut face 118*a*, 118*b*, and 118*c*, respectively. The summed wave energy from each feed guide 100*a–c* thereafter travels down final guide 116.

Figure 14A:
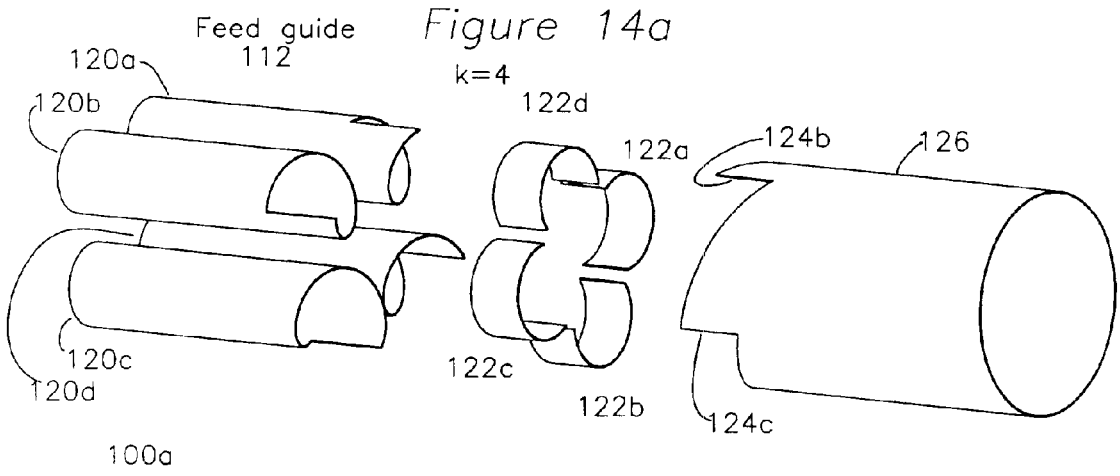
FIGS. 14*a* and 14*b* show a power combiner for asymmetric mode input power which is summing asymmetric mode input power from 4 sources.
Figure 14B:
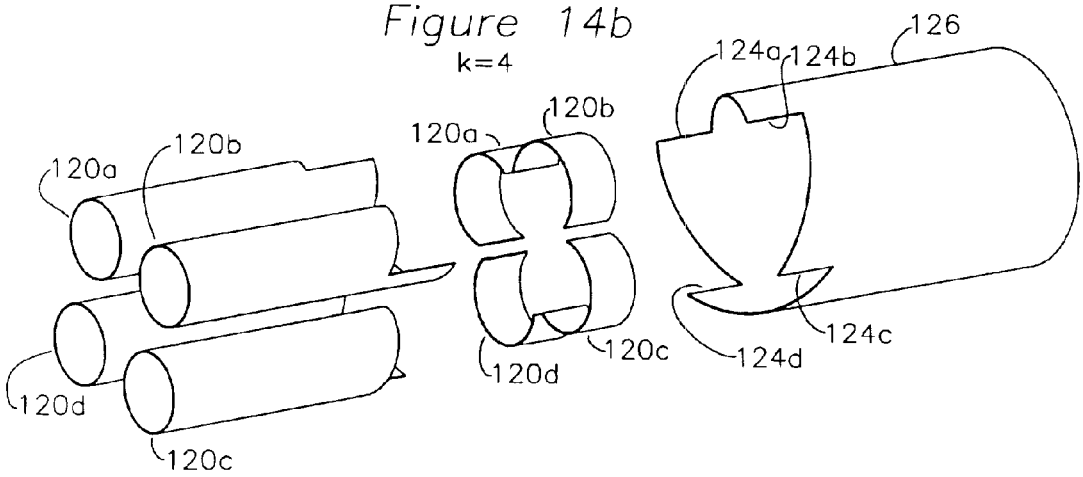

FIG. 14*a* shows the same power summer/divider for the case where k=4. As before, each feed guide 120*a–d* has a feed end and a helically cut output and described by the unwound detail of FIG. 10. The reflectors 122*a–d* capture and reflect traveling wave energy to each of the 4 multicuts 124*a*–, respectively. FIG. 14*a* and 14*b* show different views of the identical set of structures to enable clarity in viewing the helical cuts in the feed guide output waveguides 112, as well as the multicuts 124 of the final guide 126. The details of construction for the reflectors will be described later.

Figure 15:
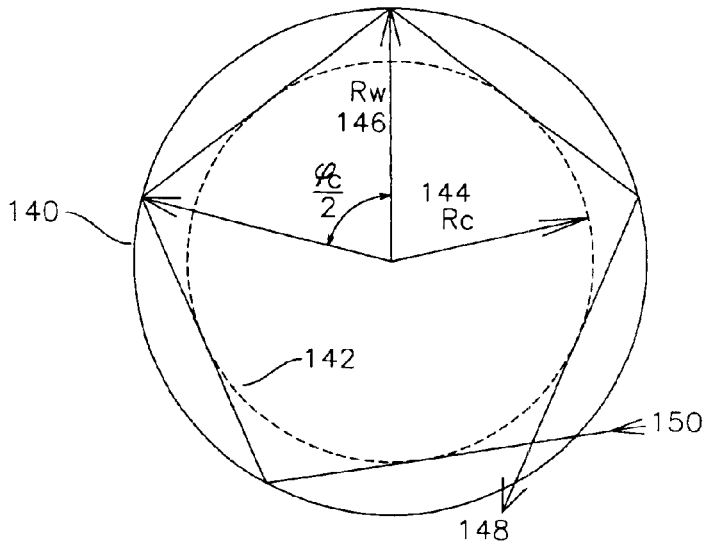
FIG. 15 shows wave propagation in a waveguide as the geometrical optical summing of a plurality of individual geometric optic waves into a helically traveling wave.

FIG. 15 shows the geometric optic ray-tracing case for a single ray 150 entering the waveguide 140 having a wall radius 146, reflecting from the walls of waveguide 140, and eventually exiting the waveguide at point 148. FIG. 15 shows this internal reflection in the projection view, where in addition to the internal reflection, the ray is also traveling down the longitudinal axis of the waveguide. A plurality of such geometric optic rays traveling through the waveguide, with all such waves sharing the same length angle and helical angle, would sum to produce traveling waves with helical propagation, with the mean radius of the traveling wave helix being located at a caustic radius Rc 144. The included angle between wall reflections is shown as $\Phi_c$ 143, where $$\Phi_c/2=2^*\text{arc cos (Rw/Rc)}=2^*\text{ arc cos (p/X}_{pq}\text{)}.$$

Figure 16:
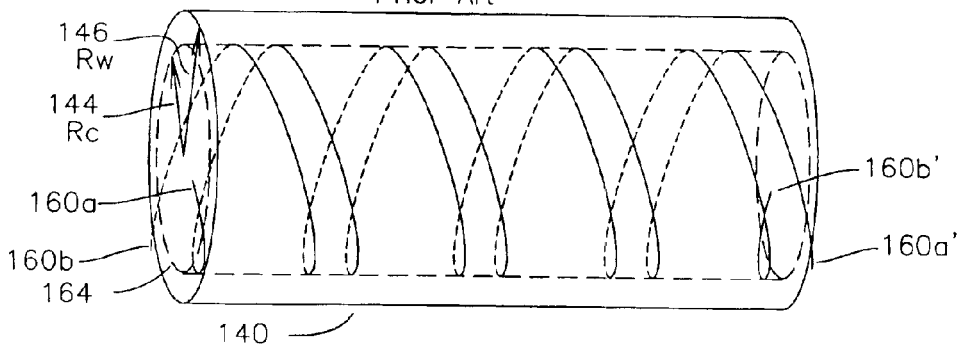
FIG. 16 shows the helically traveling wave in a waveguide.

The overall effect of summing many such rays 150 is the helical wave propagation shown in FIG. 16, where the cylindrical waveguide 140 is shown having a waveguide radius Rc 146, and a caustic radius Rc 144, and the wave energy enters at entry locations 160*a* and 160*b*, travels helically along the paths shown, and exits at egress locations 160*a'* and 160*b'*. The waves maintain their caustic radius Rc 144, a characteristic of the launch angle at entry point 160*a* and velocity of propagation in the medium carrying the wave energy, which is typically air.

Figure 17:
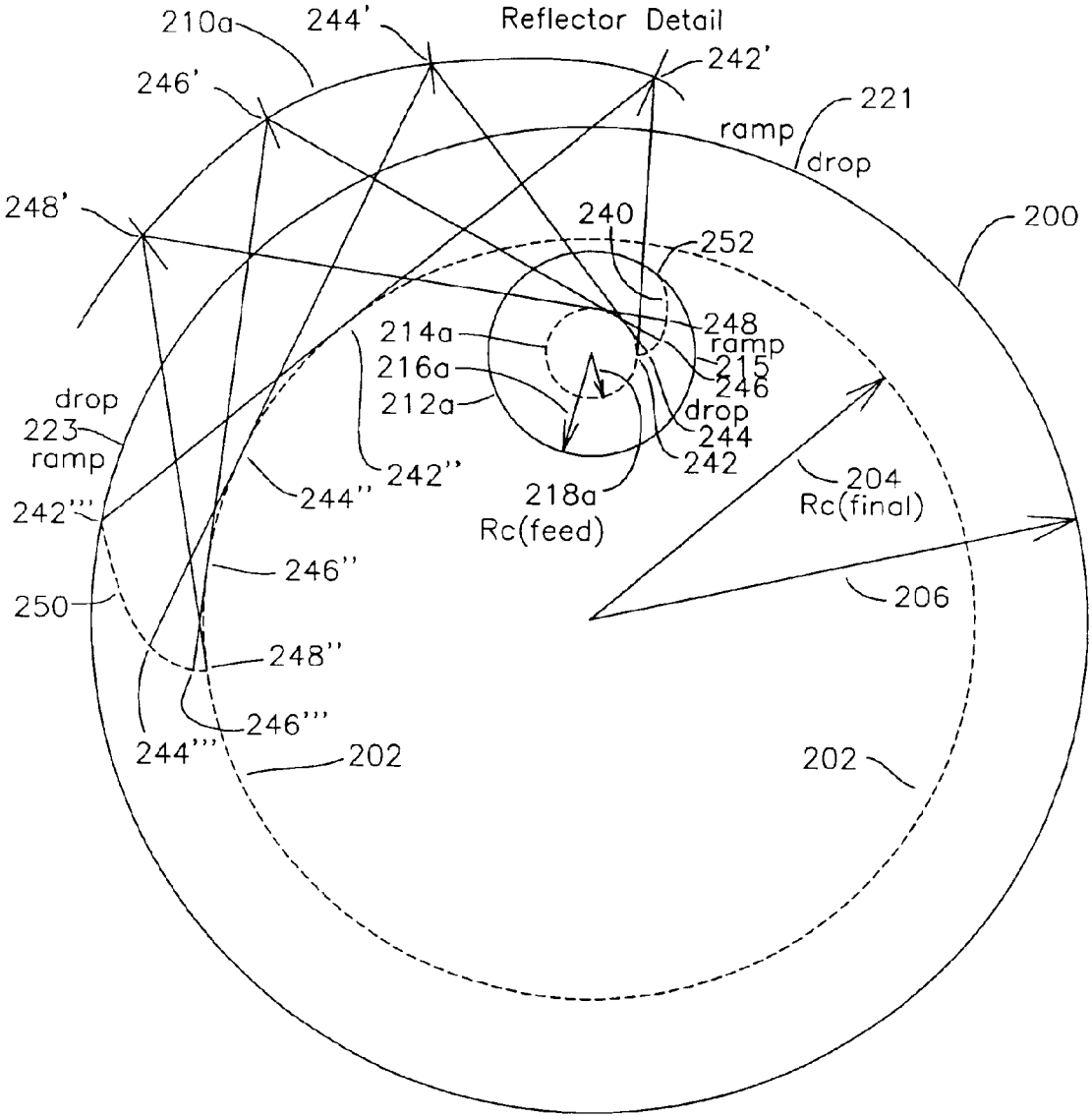
FIG. 17 shows the collapsed section view of 4 feed waveguides, the final waveguide, and the reflectors.

FIG. 17 shows the construction details for the reflectors of asymmetric combiners of FIGS. 9, 13 and 14. The symmetric mode reflector of FIG. 7 was formed using a locus of points which reflect wave energy from a first focus 51*a* to a second focus 56. In the construction of reflector of 210*a* of FIG. 17, feed guide 212*a* has a caustic Rc(feed) 218*a* as was described in FIGS. 15 and 16. Waves traveling in the feed waveguide 212*a* have a constant phase front 240, shown as an involute which starts at point 242 and curls outward to a point 252 on the waveguide wall. Similarly, final waveguide 200 has a caustic 202 with Rc(final) 204, and waves traveling in the final waveguide have a phase front 250, shown as an involute starting at point 248" and ending at point 242"'. The feed waveguide phase front 240 and final waveguide phase front 250 are specific to the mode of wave traveling in the respective waveguide, and are shown in FIG. 17 only to clarify construction details of the reflectors 210*a*. In ray tracing construction of the reflectors, the feed guide phase front 240 and final guide phase front 250 are perpendicular to the feed guide ray paths 242, 244, 246, and 248. When the reflector is formed to create equal optical path lengths from the phase front of the wave in the feed guide to the phase front of the wave in the final guide, maximal power summing is achieved. The reflector is formed by a locus of points which satisfy the following criteria for each locus point:

1) a first line segment starts at a given reflector locus point, passes tangent to the feed waveguide caustic Rc(feed), and terminates at the phase front of the feed waveguide, and a second line segment which starts at the same given reflector locus point, passes tangent to the final waveguide caustic Rc(final), and terminate on the phase front of the final waveguide.
2) the path length of the first line segment added to the second line segment is a constant. This constraint makes the electrical distance from the a point on the feed waveguide phase front to the same phase point on the final waveguide phase front equal for all such phase front points, thereby ensuring constructive addition of the wave in the final waveguide.
3) At each locus point, an intersection point is defined by the intersection of the locus point of the reflector and a line which is tangent to the reflector curve at the locus point, and a perpendicular line which is perpendicular to the tangent line at the locus point, the perpendicular line bisecting the angle formed by the first line segment and the second line segment. This constraint ensures the reflector surface at the given locus point will act to reflect energy from the feed waveguide phase front to the appropriate point on the final waveguide phase front. Using this metric, the construction of the reflector is formed by the locus of points shown on FIG. 17. Reflector 210*a* is illustrated for simplicity by 4 points which are used as examples to show how these constraints are used to construct the reflector. Phase front 240 and caustic 214*a* Rc(feed) 218*f* of the feed waveguide and phase front 250 and caustic 202 Rc(final) 204 of the final guide are known from the characteristics of the desired input and output wave mode patterns. A first line segment starts at reflector locus point 242', passes tangent to the feed caustic 214*a*, and terminates on the feed phase front point 242. A second line segment starts at reflector locus point 242', passes tangent to Rc(final) 242", and terminates at final waveguide phase front 242"'. Similarly, for given reflector locus points 244', 246', 248', there are respective first segments formed by lines which start at the reflector locus points 244', 246', and 248' respectively, pass tangent to the feed caustic Rc(feed) 214*a*, and terminate on the feed guide phase front 240 on points 244, 246, and 248. Respective second lines are formed by lines which start at respective locus points 244', 246', 248', pass tangent to the final waveguide caustic Rc(final) 202 on points 244', 246', 248', and terminate on the final waveguide phase front 250 on points 244", 246", 248" respectively. At each given point, the reflector surface 210*a* has a tangent line which includes the given point, and a line perspective to this tangent line which includes the given point on the reflector. The angle formed by the first and second line which includes the given reflector point is bisected by the perpendicular line, as is clear to one skilled in the art of reflectors and ray tracing. Thus, the entire reflector surface 210 is formed by the locus of points which meet the constraints described earlier: for each given reflector locus point, the sum of the first and second line segment lengths is equal, and at the given locus point of the reflector, a line perpendicular to the reflector surface at the given locus point bisects the angle formed by the first and second line at each given point. The locus of points which meet these criteria from the reflector surface.

Generalizing to the earlier symmetric mode case, we can further say that the reflectors follow the same constraint, where the feed and final guides for the symmetric case have a feed caustic Rc(feed) and a final caustic Rc(final) equal to 0. This simplification produces the reflectors earlier shown in FIGS. 7 and 8. FIG. 17 shows the projection view looking through the input side of the feed waveguides, through the reflector 210*a*, and finally through the final waveguide. In this view, the additional detail of the location and orientation of the helical ramp of the feed guide and the multicut ramps of the final waveguide are shown. Point 215 is shown as the tip of the helical feed waveguide, showing the "ramp" side and the "drop" side, and points 221 and 223 indicate the relative locations of the tips of two multicuts, also showing the "ramp" and "drop" side, corresponding to the features of the multicut. The points 215, 221, and 223 are shown only to aid in the understanding of the relationship between the angular orientations of the ramps on each of the structures, and may be in different places than shown in FIG. 17. In practice, the angular positions of these points is determined by maximizing power transfer from the feed waveguides, through the reflectors, and to the final guide.

Figure 18:
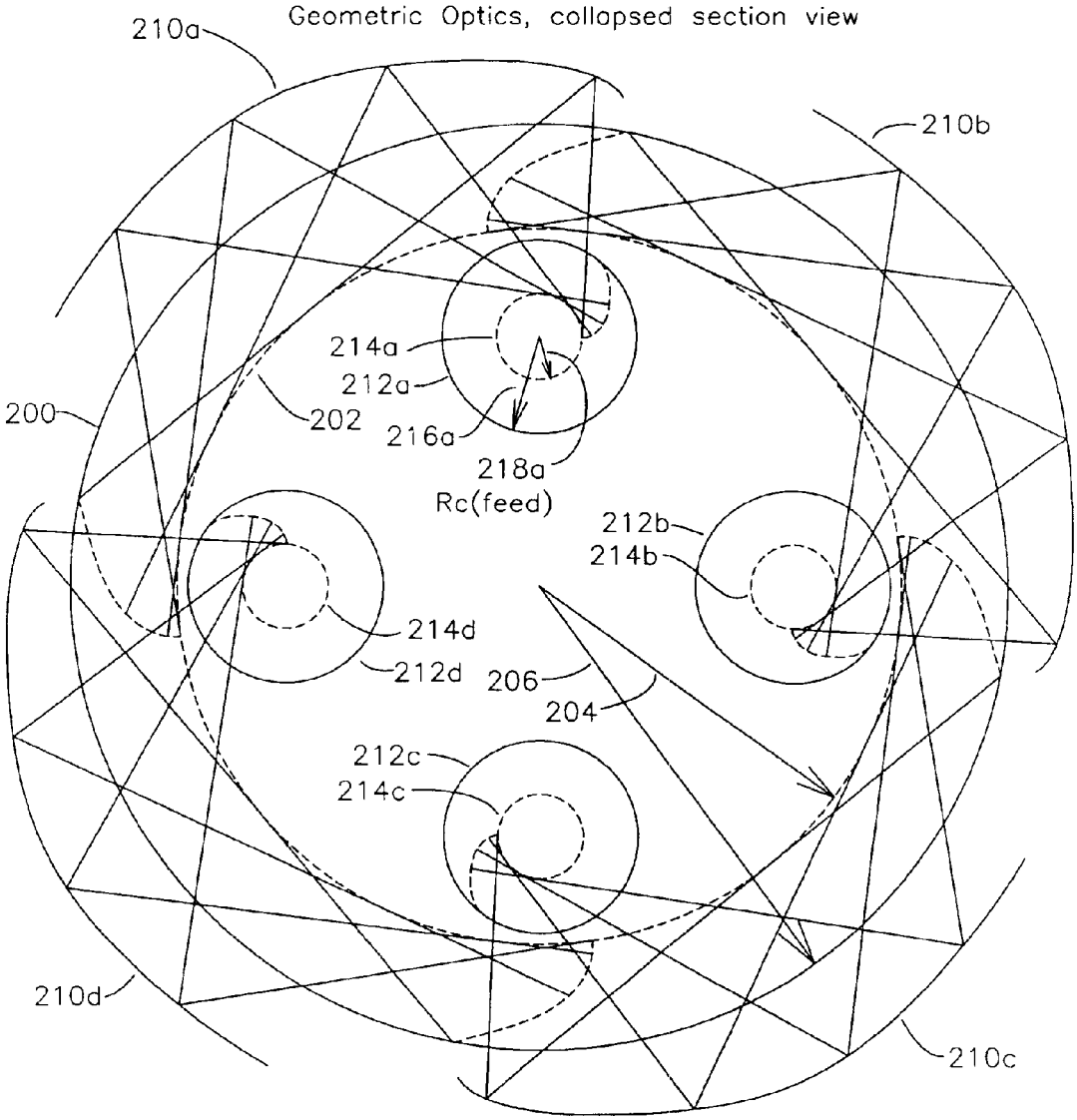
FIG. 18 shows the details of construction of a single reflector.

FIG. 18 shows the collapsed section view for all reflectors and feed guides, for the case where p=4.

Figure 19:
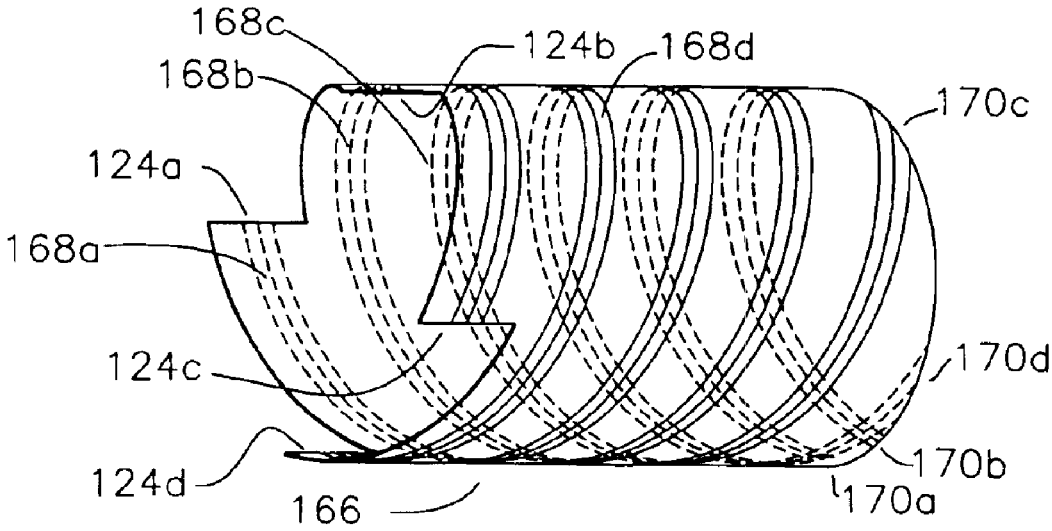
FIG. 19 shows power summing in the final waveguide.

FIG. 19 shows power summing in the final waveguide, for the case where p=4. Wave energy enters each multicut 124*a,* 124*b,* 124*c,* 124*d* from each reflector 120*a,* 120*b,* 120*c,* and 120*d* as in FIG. 14, and these sum respectively into the traveling wave groups shown entering as 168*a,* 168*b,* 168*c,* and 168*d,* and exiting as 170*a,* 170*b,* 170*c,* and 170*d.*

We claim:

1. A traveling wave device having:

a central axis about which is disposed a plurality of cylindrical feed waveguides, each said feed waveguide having a radius, an input port and a launching port, each centered on a feed waveguide axis, said launching port including a cylindrical section formed by sweeping a line of length $L_{launch}$ and said radius through an included angle $\alpha$;

a plurality of focusing reflectors, one for each said feed waveguide, each said focusing reflector centered on said feed waveguide axis;

a cylindrical final waveguide coaxial to said central axis and collecting power reflected by each said focusing reflector;

where each said focusing reflector is located between a respective feed waveguide launching port and said final waveguide.

2. The traveling wave device of claim 1 wherein said feed waveguide axis is parallel to said central axis.

3. The traveling wave device of claim 1 where each said feed waveguide radius is equal to each other said feed waveguide radius.

4. The traveling wave device of claim 1 where at least one said feed waveguide radius is different from any other said feed waveguide radius.

5. The traveling wave device of claim 1 where said feed waveguide launching port cylindrical section is convex to said central axis, and said corresponding reflector is concave to said central axis.

6. The traveling wave device of claim 5 where said feed waveguide cylindrical section and said reflector are symmetrically arranged with respect to a plane from said central axis to said feed waveguide center axis.

7. The traveling wave device of claim 5 where said feed waveguide cylindrical section and said reflector are asymmetrically arranged with respect to a plane from said central axis to said feed waveguide center axis.

8. The traveling wave device of claim 1 where said launch port has a length $L_{launch}$, where $$L_{launch}=2\pi R_{feed}\{k_{par}\mathrm{sqrt}\{1-(m/X_{mn})^2\}/\{k_{perp}\cos^{-1}(m/X_{mn})\}$$

where $k_{par}$ is the parallel, or axial wave number $R_{feed}$ is said radius of said feed waveguide m is the azimuthal index of the mode in said feed waveguide n is the radial index of the mode in said feed waveguide $X_{mn}$ is the eigenvalue of the mode $K_{perp}$ is the perpendicular wave number.

9. The traveling wave device of claim 1 where said launch port included angle is between 160 and 200 degrees.

10. The traveling wave device of claim 1 where said reflector is formed by a curve extruded along said central axis, said reflector curve comprising a locus of points.

11. The traveling wave device of claim 10 where said locus of points satisfies the following criteria, where a first focus is located on said central axis, and a second focus is located at the center of said feed waveguide:

a) the sum of the path length from said first focus to any given locus point and from said given locus point to said second focus point is a constant, b) at each locus point, an intersection point is defined by the intersection of said locus point, a tangent line which is tangent to said reflector curve at said locus point, and a perpendicular line which is perpendicular to said tangent line at said locus point, said perpendicular line bisecting the angle formed by a line from said intersection point to said first focus and said intersection point to said second focus.

12. The traveling wave device of claim 1 where said plurality comprises k feed waveguides and k reflectors, and the angular extent of each said reflector is 360/k degrees with respect to said central axis.

13. The traveling wave device of claim 1 operating as a power combiner where each said feed waveguide is coupled to a source of symmetric traveling wave power, said wave power traveling through each said feed waveguide, reflecting from said reflector and collecting in said final waveguide.

14. The traveling wave device of claim 1 operating as a power splitter where said final waveguide is coupled to a source of traveling wave power, said traveling wave power exiting said final waveguide at a reflector end, reflecting from each said reflector and thereafter coupling to each said feed waveguide launch port, delivering traveling wave power to each said input port.

15. The traveling wave device of claim 14 operating as a power splitter where the power applied to said final waveguide splits uniformly between each said feed waveguide input port.

16. The traveling wave device of claim 14 operating as a power splitter where the power applied to said final waveguide splits unevenly between at least one said feed waveguide and any other said feed waveguide.

17. The traveling wave device of claim 1 where said feed waveguides, said reflector, and said final waveguide are electrically conductive.

18. The traveling wave device of claim 1 where said feed waveguides, said reflector, and said final waveguide have an electrically conductive surface.

19. The traveling wave device of claim 1 where said feed waveguide launching port cylindrical section is concave to said central axis, and said corresponding reflector is convex to said central axis.

20. The traveling wave device of claim 19 where said feed waveguide cylindrical section and said reflector are symmetrically arranged with respect to a plane from said central axis to said feed waveguide center axis.

21. The traveling wave device of claim 19 where said feed waveguide cylindrical section and said reflector are asymmetrically arranged with respect to a plane from said central axis to said feed waveguide center axis.

22. A traveling wave device comprising:

a plurality k of feed waveguides arranged about a central axis, each said feed waveguide formed from a conductive polygon, said polygon formed from a first rectangle having a width and a height, and a second rectangle adjoined to said first rectangle height edge, said second rectangle having a width $L_{launch}$ and a height less than said first rectangle height, said polygon rolled into a cylinder having a feed waveguide axis parallel to said first rectangle width, said feed waveguide having a power output end and a second rectangle end;

a plurality of focusing reflectors, one for each said feed waveguide;

a cylindrical final waveguide;

said k is an integer greater than 1;

where each said focusing reflector is located between a respective feed waveguide second rectangle end and said final waveguide.

23. The traveling wave device of claim 22 where said feed waveguide axis is parallel to said central axis.

24. The traveling wave device of claim 22 where each said feed waveguide radius is equal to each other said feed waveguide radius.

25. The traveling wave device of claim 22 where at least one said feed waveguide radius is different from any other said feed waveguide radius.

26. The traveling wave device of claim 22 where said feed waveguide second rectangle end is convex to said central axis, and said corresponding reflector is concave to said central axis.

27. The traveling wave device of claim 26 where said feed waveguide second rectangle end and said reflector are symmetrically arranged with respect to a plane from said central axis to said feed waveguide center axis.

28. The traveling wave device of claim 26 where said feed waveguide second rectangle end and said reflector are asymmetrically arranged with respect to a plane from said central axis to said feed waveguide center axis.

29. The traveling wave device of claim 22 where said second rectangle width $L_{launch}$, is $$L_{launch}=2\pi R_{feed}\{k_{par}\mathrm{sqrt}\{1-(m/X_{mn})^2\}/\{k_{perp}\cos^{-1}(m/X_{mn})\}$$

where $k_{par}$ is the parallel, or axial wave number $R_{feed}$ is said radius of said feed waveguide m is the azimuthal index of the mode in said feed waveguide n is the radial index of the mode in said feed waveguide $X_{mn}$ is the eigenvalue of the mode $K_{perp}$ is the perpendicular wave number.

30. The traveling wave device of claim 22 where said feedguide second rectangle height is selected such that said second rectangle end has an included angle between 160 and 200 degrees.

31. The traveling wave device of claim 22 where said reflector is formed by a curve extruded along said central axis, said reflector curve comprising a locus of points.

32. The traveling wave device of claim 31 where said locus of points satisfies the following criteria, where a first focus is located on said central axis, and a second focus is located at the center of said feed waveguide:

a) the sum of the path length from said first focus to any give locus point and from said given locus point to said second focus point is a constant, b) at each locus point, at intersection point is defined by the intersection of said locus point, a tangent line which is tangent to said reflector curve at said locus point, and a perpendicular line which is perpendicular to said tangent line at said locus point, said perpendicular line bisecting the angle formed by a line from said intersection point to said first focus and said intersection point to said second focus.

33. The traveling wave device of claim 22 where said plurality comprises k feed waveguides and k reflectors, and the angular extent of each said reflector is 360/k degrees with respect to said central axis.

34. The traveling wave device of claim 22 operating as a power combiner where each said input waveguide is coupled to a source of symmetric traveling wave power, said input power traveling through each feed waveguide, reflecting from said reflector and collected in said final waveguide.

35. The traveling wave device of claim 22 operating as a power splitter where said final waveguide is coupled to a source of traveling wave power, said traveling wave power exiting said final waveguide at a reflector end, reflecting from each said reflector and thereafter coupling to each said feed waveguide launch port, delivering traveling wave power to each said feed waveguide.

36. The traveling wave device of claim 35 operating as a power splitter where the power applied to said final waveguide splits uniformly between each said feed waveguide.

37. The power traveling wave device of claim 35 operating as a power splitter where the power applied to said final waveguide splits unevenly between at least one said feed waveguide and any other said feed waveguide.

38. The traveling wave device of claim 22 where said feed waveguides, said reflector, and said final waveguide are electrically conductive.

39. The traveling wave device of claim 22 where said feed waveguides, said reflector, and said final waveguide have an electrically conductive surface.

40. The traveling wave device of claim 22 where said feed waveguide launching port cylindrical section is concave to said central axis, and said corresponding reflector is convex to said central axis.

41. The traveling wave device of claim 40 where said feed waveguide cylindrical section and said reflector are symmetrically arranged with respect to a plane from said central axis to said feed waveguide center axis.

42. The traveling wave device of claim 40 where said feed waveguide cylindrical section and said reflector are asymmetrically arranged with respect to a plane from said central axis to said feed waveguide center axis.

* * * * *